United States Patent [19]

Schneider et al.

[11] Patent Number: 4,593,653

[45] Date of Patent: Jun. 10, 1986

[54] DISTRIBUTOR FOR TWO-PHASE MIXTURES, ESPECIALLY WATER-STEAM MIXTURES IN FORCED-CIRCULATION BOILERS

[75] Inventors: Egon Schneider, Grossenseebach; Wolfgang Köhler, Kalchreuth, both of Fed. Rep. of Germany

[73] Assignee: Kraftwerk Union Aktiengesellschaft, Mülheim, Fed. Rep. of Germany

[21] Appl. No.: 647,255

[22] Filed: Aug. 31, 1984

Related U.S. Application Data

[63] Continuation of Ser. No. 528,992, Sep. 2, 1983, abandoned, which is a continuation of Ser. No. 309,067, Oct. 6, 1981, abandoned.

[30] Foreign Application Priority Data

Oct. 30, 1980 [DE] Fed. Rep. of Germany ..... 3040927

[51] Int. Cl.[4] ..... F22B 37/22

[52] U.S. Cl. ..... 122/365; 122/357; 122/451 R; 122/31 R; 122/32; 137/561 A

[58] Field of Search ..... 122/451, 357, 39, 40, 122/31 R, 32, 235 D, 235 F, 254–258, 360, 363, 365; 137/561 A

[56] References Cited

U.S. PATENT DOCUMENTS

| | | | |
|---|---|---|---|
| 629,520 | 7/1899 | Mond | 122/31 R |
| 1,599,726 | 9/1926 | Smith | 122/256 |
| 1,650,632 | 11/1927 | Kowallik | 122/451 R |
| 1,887,147 | 11/1932 | DeBaufre | 122/451 R |
| 2,239,895 | 4/1941 | Kuhner | 122/365 |
| 2,299,849 | 10/1942 | Rees | 122/31 R |
| 3,048,373 | 8/1962 | Bauer et al. | 122/32 |
| 3,886,906 | 6/1975 | Wolfgarten | 122/32 |
| 4,140,178 | 2/1979 | Ohlswager et al. | 137/561 A |
| 4,333,629 | 6/1982 | Roy | 137/561 A |

*Primary Examiner*—Henry C. Yuen

*Attorney, Agent, or Firm*—Herbert L. Lerner; Laurence A. Greenberg

[57] ABSTRACT

Distributor for two-phase mixtures, including a distributor drum, a feed tube leading into the distributor drum in a given direction, a plurality of outlet tubes leading from the distributor drum at an angle to the given direction, and a flat baffle plate being disposed in the distributor drum at a right angle to the given direction, the baffle plate having an edge leading symmetrically and smoothly to the outlet tubes.

8 Claims, 2 Drawing Figures

Figure 1:
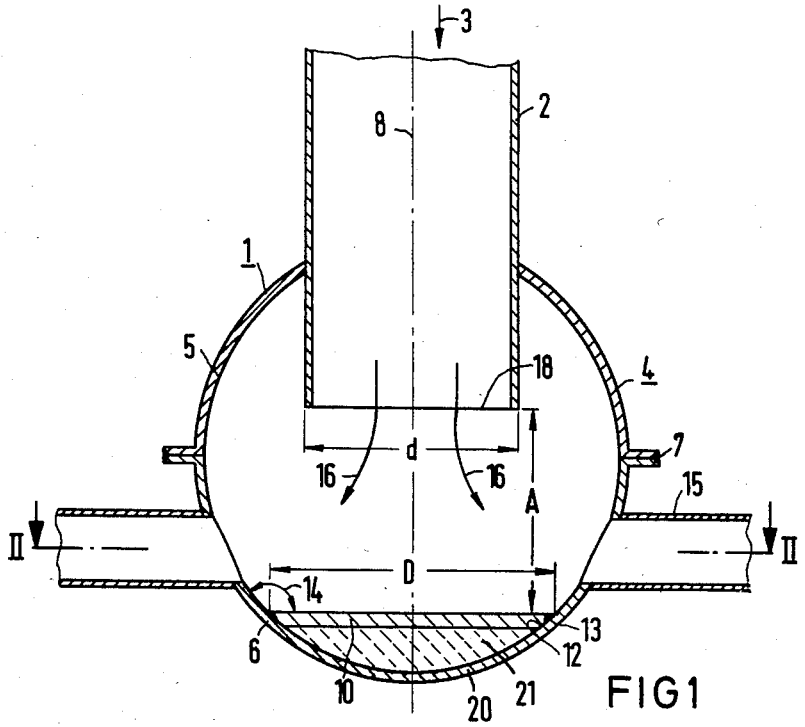

DISTRIBUTOR FOR TWO-PHASE MIXTURES, ESPECIALLY WATER-STEAM MIXTURES IN FORCED-CIRCULATION BOILERS

This application is a continuation, of application Ser. No. 528,992, filed Sept. 2, 1983, now abandoned which is a continuation of application Ser. No. 309,067, filed Oct. 6, 1981, now abandoned.

The invention relates to a distributor for two-phase mixtures, especially water-steam mixtures, in forced-circulation boilers, with a distributor drum into which a feed tube leads and from which several outlet tubes start that are disposed at an angle to the direction of the feed tube.

Such distributors are provided, for instance, between different boiler regions, wherein after initial heating in relatively large tube cross sections, a transfer to superheater regions with larger numbers of tubes having smaller cross sections takes place. The distribution over the outlet tubes should be as uniform as possible so as to avoid negative effects such as superheating in weakly-stressed boiler regions. This problem has not been satisfactorily solved heretofore. However, similar distribution problems with non-uniform two-phase mixtures can also arise in chemical operations and fluid-dynamics laboratories, etc.

It is accordingly an object of the invention to provide a distributor for two-phase mixtures, especially water-steam mixtures, in forced-circulation boilers, which overcomes the hereintofore-mentioned disadvantages of the heretofore-known devices of this general type.

With the foregoing and other objects in view there is provided, in accordance with the invention, a distributor for two-phase mixtures, especially water-steam mixtures in forced-circulation boilers, comprising a distributor drum, a feed tube leading into the distributor drum in a given direction, a plurality of outlet tubes leading or starting from the distributor drum at an angle to the given direction, and a flat baffle plate being disposed in the distributor drum at a right angle or perpendicular to the given direction, the baffle plate having an edge leading symmetrically and smoothly to the outlet tubes.

With such a baffle plate, uniformity is achieved by the provision that the liquid component exiting from the feed tube runs from the stagnation point, independently of its distribution over the tube cross section, uniformly to all sides due to the change in direction on the flat baffle plate. The liquid component then continues to flow-on undisturbed on the rim of the plate, which in the invention leads symmetrically and smoothly to the outlet tubes, so that the uniformity is preserved independently of irregularities of the flow in the feed tube and the outlet tubes are acted upon similarly, i.e. by equal shares of liquid and steam medium.

The symmetrical arrangement of the edge with respect to the outlet tubes is obtained in an optimum manner if, in accordance with another feature of the invention, the distributor drum is rotation symmetrical and the baffle plate is a circular disc being disposed opposite to the cylindrical feed tube in the distributor drum. In principle, it is also conceivable, however, to construct the baffle plate as a regular polygon if there are only relatively few outlet tubes. The outlet tubes are disposed at the corners of the polygon.

The edge which leads smoothly to the outlet tubes is to prevent the liquid component which is uniformly distributed at the baffle plate from becoming uneven again through disturbances due to the deflection, such as corners at the rim. To this end, the edge may lead to the outlet tubes in an inclined and especially curved manner. In any event, corners with walls extending at acute angles to each other should be avoided, while corners with obtuse angles of, for instance, more than 135° are permissible because they no longer provide disturbances in practice.

As already mentioned, a rotation-symmetrical arrangement of the distributor is advantageous particularly for large numbers of tubes, with eight or more tubes in one distributor drum. Then, in accordance with a further feature of the invention, the circular disc has a larger diameter than the feed tube and should be, for instance 1.2 to 2 times that value. For nonrotation-symmetrical arrangements, logically similar dimensions are chosen.

The distance from the baffle plate to the mouth of the feed tube must be at least large enough so that the baffle plate does not exert a backup effect with an undesirably large flow resistance. In accordance with an added feature of the invention, the feed tube has a mouth being spaced from the baffle plate at a distance being substantially equal to the diameter of the feed tube.

In accordance with an additional feature of the invention, which is particularly advantageous with respect to thermal stresses, the distributor drum is spherical and is divided into two halves, the baffle plate and outlet tubes being disposed in one of the halves and the feed tube being disposed in the other of the halves, the halves being welded together or having flanges thereon being connected to each other.

In accordance with again another feature of the invention, the baffle plate has a side thereof facing away from the feed tube being adapted to the spherical shape of the distributor drum in order to obtain uniform setting. However, other advantageous constructions of the plate, which may be stressed by vibrations, are also conceivable, as will be explained hereinbelow.

In accordance with a concomitant feature of the invention, the baffle plate is in the form of a flat wall portion integral with the distribution drum. In this case, the baffle plate is therefore not an additional part, but a specially formed portion of the distributor drum itself. This portion can be an integral part of the wall of the distributor drum which is, for instance, made as a forging. However, it can also be formed by a welded-in bottom of a special material, if desired.

Other features which are considered as characteristic for the invention are set forth in the appended claims. Although the invention is illustrated and described herein as embodied in a distributor for two-phase mixtures, expecially water-steam mixtures, in forced-circulation boilers, it is nevertheless not intended to be limited to the details shown, since various modifications and structural changes may be made therein without departing from the spirit of the invention and within the scope and range of equivalents of the claims.

Figure 2:
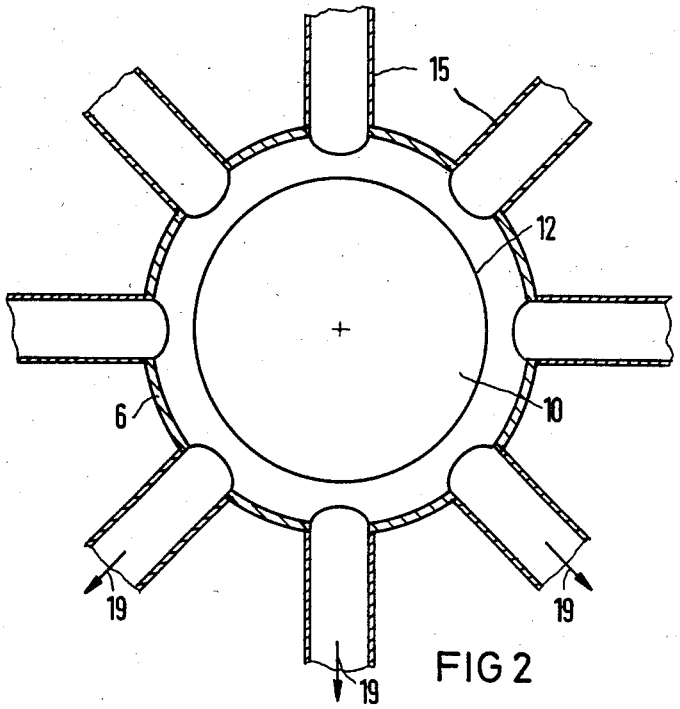

The construction and method of operation of the invention, however, together with additional objects and advantages thereof will be best understood from the following description of specific embodiments when read in connection with the accompanying drawings, in which:

FIG. 1 is a fragmentary, diagrammatic vertical sectional view of an embodiment of the invention; and FIG. 2 is a fragmentary horizontal sectional view taken along the line II—II in FIG. 1, in the direction of the arrows.

Referring now to FIG. 1 and 2 of the drawing as a whole, there is seen a distributor 1 which is part of a forced-circulation boiler for fossil fuel. The distributor is mounted between a first heating zone acted upon by feedwater and a second heating zone in which further evaporation and/or superheating takes place. Therefore, a water-steam mixture comes out of the first heating zone with a pressure of, for example, 90 to 160 bar in a feed tube 2, in the direction of the arrow 3. The water flows with a velocity of, for instance, 2 to 6 m/sec, especially along the walls of the tube 2, while the steam has a velocity of 15 to 20 m/sec primarily in the center of the circular cross section of the tube.

The tube 2 has a diameter d of, for instance, 360 mm. The tube 2 projects by about the same distance as this diameter into a spherical distributor drum 4 which is welded together from two half spheres 5 and 6 at a weld 7. The diameter of the sphere is 700 mm.

In the distributor drum 4, a flat circular disc in the form of a baffle plate 10 is rotationally-symmetrically disposed relative to the axis 8 of the feed tube 2 which is shown in dot-dash lines and passes through the center of the sphere 4. The baffle plate 10 is exactly opposite the feed tube or line 2. The plane in which the baffle plate 10 is disposed forms a right angle with the vertical axis 8 of the feed tube 2, with the axis 8 going through the center of the circle of the baffle plate 10.

The edge 12 of the baffle plate is welded to the wall of the lower half 6 of the drum 4, a smooth transition being provided. In any event, an angle 14 produced at a welded seam 13, which is 150°, is by far larger than an acute angle. This results in a smooth transition from the baffle plate 10 to outlet tubes 15 which are disposed at the lower part 6 of the drum and are symmetrically distributed over the circumference, as FIG. 2 shows.

The diameter D of the baffle plate 10 at 460 mm is more than $\frac{1}{4}$ larger than the diameter d of the feed tube 2. This provides for an expanding Jet, which is indicated by arrows 16, to also strike the baffle plate 10 at a distance from the edge 12 which is sufficient for uniform propagation. For this purpose, the diameter D can also be chosen to be larger, such as 2*d*.

The distance A at which the baffle plate 10 is displaced from the mouth 18 of the feed tube 2 is advantageously 1 to 4 times the diameter d. However, the value is not critical and can be chosen to be smaller, especially for low flow velocities. A distance of 0.8 d may be chosen, for example, if this does not cause undesirable choking of the flow.

When using the baffle plate 10 according to the invention, the water of the two-phase system which is asymmetrically fed in the feed tube 2 due to pipe elbows or because of other reasons, is distributed uniformly over the flat surface of the baffle plate 10. In this way a uniform distribution over the eight outlet tubes 15 distributed over the edge of the lower part 6 is also obtained. This means that the further non-illustrated regions of a superheater zone in the boiler which are connected by the outlet tubes 15, are uniformly acted upon by the liquid and the steam in the desired manner, as is shown by the arrows 19. Local overheating is thereby prevented.

In another embodiment of the invention, the plate which is disposed opposite the feed tube 2 at right angles and symmetrically, is formed by the wall of the distributor drum 4 itself. In order to accomplish this, the spherical zone 20 below the baffle plate 10 is omitted. On the other hand, the side of the baffle plate 10 facing away from the tube 2 can also be adapted, as shown by oblique dashed lines 21, to the spherical shape of the half 6.

In the embodiment examples, a short portion of the lower half of the sphere lies between the edge 12 and the outlet tubes 15. The baffle plate 10, however, can also be constructed and disposed in such a way that it optionally has a dish-shaped edge that extends directly to the outlet tubes 15.

We claim:

1. Distributor for two-phase mixtures comprising a distributor drum having an inner surface, a feed tube leading fluid into said distributor drum in a given direction, a plurality of outlet tubes having open ends connected to and leading fluid away from said distributor drum at an angle to the given direction, and a flat baffle plate being disposed in said distributor drum at a given level opposite said feed tube, said baffle plate being fluid impermeable and having a peripheral edge, said baffle plate being connected and sealed to said inner surface of said distributor drum along the entirety of said peripheral edge, and said peripheral edge being connected symmetrically and smoothly to said open ends of said outlet tubes by said inner surface of said distributor drum, said baffle plate continuously guiding fluid above said baffle plate directly into said open ends of said outlet tubes for discharging from said distributor drum along said given level.

2. Distributor according to claim 1, wherein said distributor drum is rotation symmetrical and said baffle plate is a circula disc being disposed opposite to said cylindrical feed tube in said distributor drum.

3. Distributor according to claim 2, wherein said circular disc has a larger diameter than said feed tube.

4. Distributor according to claim 2 or 3, wherein said feed tube has a mouth being spaced from said baffle plate at a distance being substantially equal to the diameter of said feed tube.

5. Distributor according to claim 1, wherein said distributor drum is spherical and is divided into two halves, said baffle plate and outlet tubes being disposed in one of said halves and said feed tube being disposed in the other of said halves, said halves being welded together.

6. Distributor according to claim 1, wherein said distributor drum is spherical and is divided into two halves, said baffle plate and outlet tubes being disposed in one of said halves and said feed tube being disposed in the other of said halves, said halves having flanges thereon being connected to each other.

7. Distributor according to claim 5 or 6, wherein said baffle plate has a side thereof facing away from said feed tube being adapted to the spherical shape of said distributor drum.

8. Distributor according to claim 1, wherein said baffle plate is in the form of a flat wall portion integral with said distributor drum.

* * * * *